US006299323B1

(12) United States Patent
Yu et al.

(10) Patent No.: US 6,299,323 B1
(45) Date of Patent: Oct. 9, 2001

(54) MINIATURE LED FLASHLIGHT

(76) Inventors: Sun Yu, 2850 Coolidge, Berkley, MI (US) 48072; Anmena Yau, Rm 2109, 9F., Mega Trade Centre, 1-6 Mei Wan Street, Tsuen Wan, N.T., Hong Kong (HK)

( * ) Notice: Subject to any disclaimer, the term of this patent is extended or adjusted under 35 U.S.C. 154(b) by 0 days.

(21) Appl. No.: 09/687,396

(22) Filed: Oct. 13, 2000

(51) Int. Cl.[7] ..... F21V 33/00

(52) U.S. Cl. ..... 362/116; 362/196; 362/200; 362/201

(58) Field of Search ..... 362/116, 196, 362/200, 201

(56) References Cited

U.S. PATENT DOCUMENTS

| | | | |
|---|---|---|---|
| D. 422,731 | 4/2000 | Parsons et al. | D26/46 |
| 4,692,846 | 9/1987 | Johnson | 362/104 |
| 4,745,527 | 5/1988 | Belverio, Jr. et al. | 362/100 |
| 4,774,643 | 9/1988 | McGinnis et al. | 362/189 |
| 4,800,469 | 1/1989 | Leon | 362/72 |
| 5,158,356 | 10/1992 | Guthrie | 362/188 |
| 5,303,131 | 4/1994 | Wu | 362/103 |
| 5,386,351 | 1/1995 | Tabor | 362/201 |
| 5,463,539 | 10/1995 | Vandenbelt et al. | 362/189 |
| 5,515,248 | 5/1996 | Canfield et al. | 362/116 |
| 5,893,631 | 4/1999 | Padden | 362/201 |
| 6,006,562 * | 12/1999 | Wolter | 362/116 |
| 6,190,018 * | 2/2001 | Parsons et al. | 362/200 |

* cited by examiner

*Primary Examiner*—Stephen Husar
(74) *Attorney, Agent, or Firm*—Gifford, Krass, Groh, Sprinkle, Anderson & Citkowski, P.C.

(57) ABSTRACT

A miniature LED flashlight is provided having a battery with opposing surfaces of opposite polarity and an LED having two leads extending therefrom, the battery and the LED received within a molded lower panel. A adapted to press fit with the lower panel in simultaneous contact with the frame creates a flashlight that is readily opened to interchange and replace component parts. The upper panel also has an upper surface, a side and an aperture extending through the upper surface. The side of the upper surface has a notch receive a lever for detaching the upper panel. Transverse finger pressure on the aperture urges the LED leads into contact with the opposing surfaces of the battery thereby illuminating the LED. A dual mode switch is also provided to slide within the aperture. The resulting flashlight may exist as a self-contained variety of outer housing structures.

22 Claims, 2 Drawing Sheets

MINIATURE LED FLASHLIGHT

FIELD OF THE INVENTION

The present invention relates to miniature flashlights and, more particularly, to a reusable flashlight having multiple operational modes.

BACKGROUND OF THE INVENTION

With the advent of light emitting diodes (LEDs), compact, high flux illuminating devices became available. These illuminating devices have traditionally been constructed with two complementary shell components encasing an LED and a battery with an aperture in one component for a finger-activated button. Owing to the simple nature of these "clamshell" devices, sonic welding or adhesives are used to permanently seal the illuminating device. Upon expending the battery or damage to a device component, such illuminating devices are discarded thereby adding to the consumer waste stream.

There exists growing appreciation for the need to minimize waste streams and, in particular, waste streams such as batteries that over time may leak acids or toxic metals. Further, a device with interchangeable and replaceable components justifies further engineering to provide a more reliable and adaptable illuminating device.

Owing to the disposable mind-set invoked to design prior art illuminating devices, little attention has been paid to creating an illuminating device with multiple operating modes. Thus, there exists a need for a miniature LED flashlight having replaceable component parts.

SUMMARY OF THE INVENTION

A flashlight according to the present invention includes a battery having opposite polarity surfaces, an LED having two leads extending therefrom and a lower panel adapted to receive the battery and LED such that the LED leads can engage the opposing surfaces of the battery. A frame is attached to the lower panel, and an upper panel having an upper surface, a side and an aperture extending through the upper surface snap fits with the lower panel in simultaneous contact with the frame.

In another embodiment, the flashlight according to the present invention includes a button battery, an LED having two leads extending therefrom with the first LED lead in constant contact with a battery pole and a lower panel adapted to receive both the battery and the LED. A metal frame is attached to the lower panel, with a portion of the frame being configured as a hook. A spring affixed to the frame is urged into contact with the hook portion of the frame. An upper panel having an upper surface, an aperture extending through the upper surface and a side having a notch such that a wall of the notch is defined by the frame includes snap fittings adapted to press fit with the lower panel in simultaneous contact with the frame. Transverse finger pressure applied through the upper panel aperture is sufficient to urge the second lead into contact with the opposing polarity battery pole thereby activating the LED.

DETAILED DESCRIPTION OF THE PREFERRED EMBODIMENTS

Figure 1:
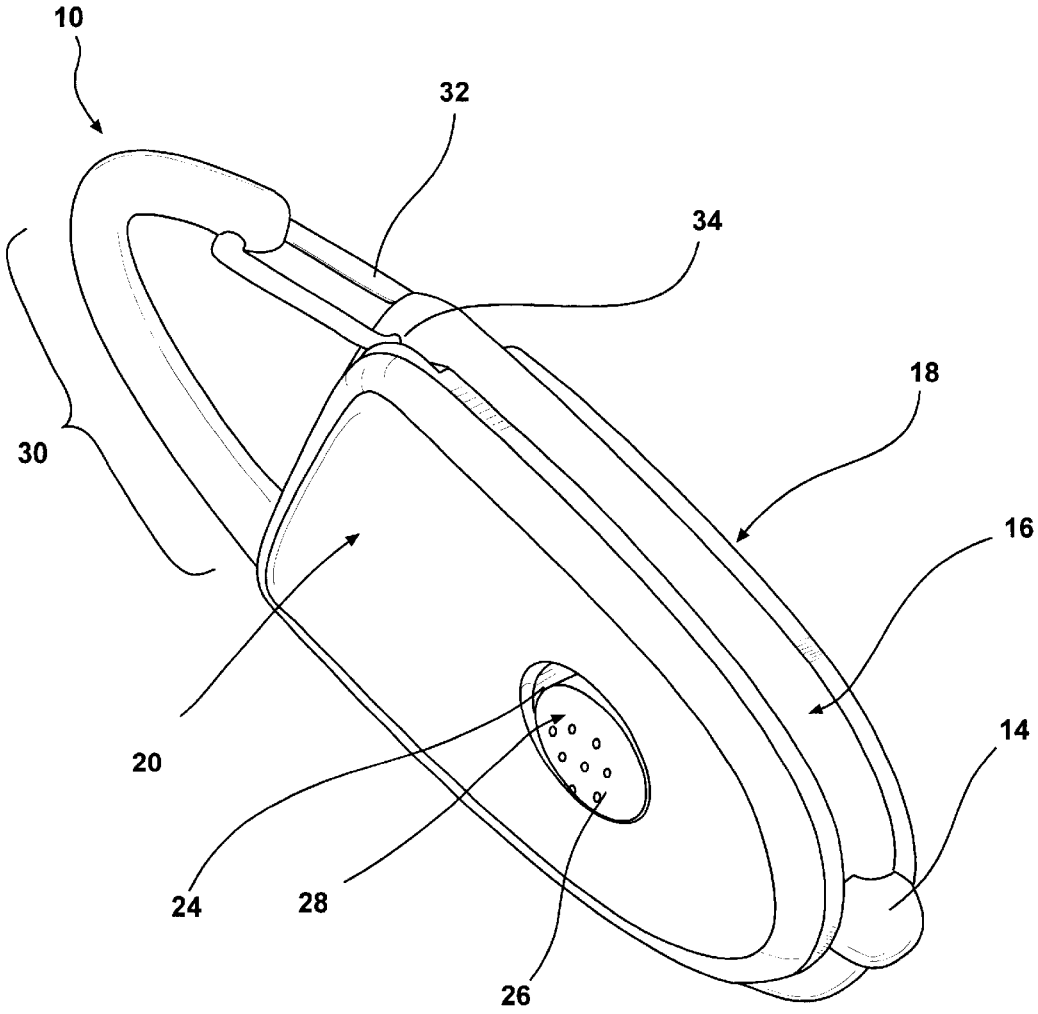
FIG. 1 is a perspective view of a miniature LED flashlight according to the present invention.
Figure 2:
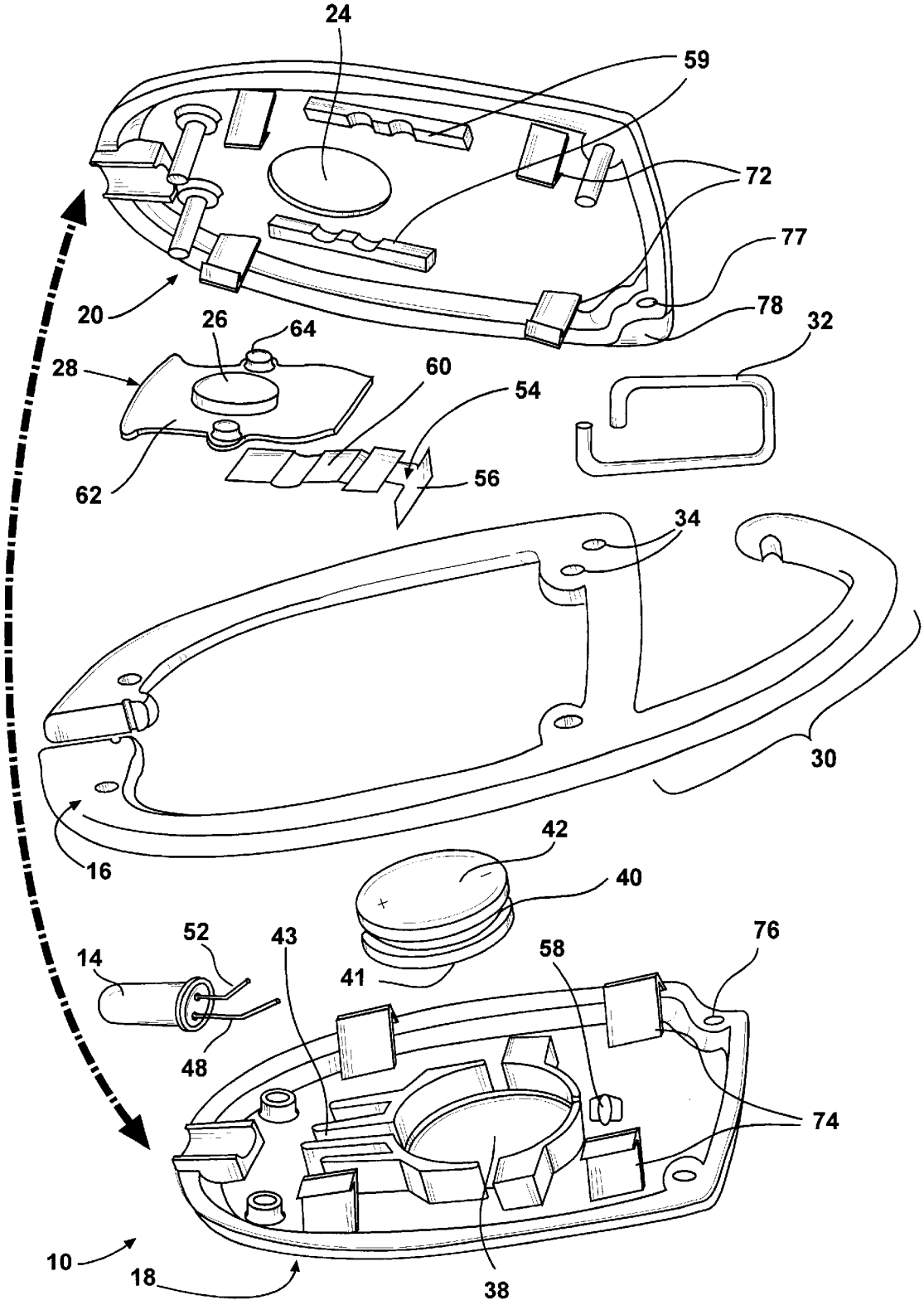
FIG. 2 is an exploded view of the embodiment of the present invention depicted in FIG. 1.

With reference now to FIGS. 1 and 2, the overall flashlight of the present invention is shown at 10. A light emitting diode (LED) 14 is bounded diametrically by a frame 16. The LED being of any color including red, yellow and blue. A GaN LED is particularly preferred owing to the ophthalmic sensitivity to blue and the intensity thereof. The frame 16 being intermediate between a lower panel 18 and an upper panel 20. The upper panel 20 having an aperture 24. The aperture 24 adapted to receive the boss portion 26 of a switch generally shown at 28. The frame 16 is optionally formed to define a hook portion 30. Pivotal attachment of a spring clip 32 to a portion of the frame 16 urges the spring clip 32 into pivotable contact with the hook portion 30 of the metallic frame 16. The metallic spring 32 inserting into offset holes 34 within the metallic frame 16. Rotation of metallic spring 32 about the offset and opposing holes 34 exerts a spring-like tension on the hook portion 30. It is appreciated that the frame 16 need not terminate in a hook, but rather is crafted into decorative and utilitarian forms illustratively including a flush form, a swivel, a loop, a magnetic fastener and a sculpted ornament. Preferably, the frame 16 is metal. A metallic frame according to the present invention is cast from a metal illustratively including pot metal, aluminum, steel, pewter and brass. It is appreciated that a metallic frame according to the present invention is also readily formed through machining of a blank. Optionally, a frame according to the present invention is also formed of high ductility, high strength polymeric materials illustratively including epoxy, polycarbonate, LEXAN (Du Pont de Nemours and Company), fiber reinforced or metallic granulate reinforced forms thereof, and mixtures thereof. More preferably, a frame according to the present invention is formed from cast pot metal. Optionally, the frame is plated or otherwise coated to impart a protective or decorative appearance thereto.

The lower panel 18 is formed of an injected moldable thermoplastic material. Optionally, the lower or upper panel according to the present invention is formed of a translucent thermoplastic. The lower panel 18 has a recess 38 adapted to receive a button type battery 40 having a first pole face 41 and an opposite polarity face 42. Typically, the battery used herein is a lithium battery. The sidewalls of the recess 38 have a slot 43 therein, the slot 43 spaced to allow a lead 48 of the LED 14 to come into electrical contact with one pole of the battery 40. A terminal recess 50 is adapted to receive the LED 14. A second lead 52 of the LED 14 is supported by a portion of the lower panel 18 so as to afford selective electrical contact between the second lead 52 and the opposing pole 42 of the battery 40. In a preferred embodiment, selective electrical contact between the second lead and the opposing pole of the battery 40 is provided by a leaf spring 54. The leaf spring 54 having an anchoring portion 56 adapted to be received within a slot 58 within lower panel 18. The leaf spring 54 spans battery 40 and extends to a position over the second LED lead 52. By placing a transverse pressure on the leaf spring 54, the conductive leaf spring simultaneously contacts the second LED lead 52 and the opposing battery pole 42 thereby completing an electrical circuit and energizing the LED 14. The leaf spring 54 is urged into simultaneous contact with the second LED lead 52 and the opposite pole 42 of the battery 40 by the switch 28 in contact with the upper surface 60 of the leaf spring 54. The switch 28 held in relative position to the leaf spring by guide rails 59 formed in the lower side of upper panel 20. The boss 26 extending from switch 28 extends through aperture 24 of the upper panel 20. The boss 26 slides within aperture 24 with the application of lateral pressure to the boss. The switch 28 has a pedestal 62 extending beneath the boss 26 adapted to retain the boss 26 within the flashlight 10. Extending from the pedestal 62 on opposite sides and extending toward the upper panel is a locking post 64. The locking post 64 is adapted to engage complementary indentations molded within rails 59 of the upper panel 20. The switch 28 has a rocking undercarriage 70 extending beneath the pedestal. The rocking undercarriage 70 engaging the sidewalls defining the battery recess 38. As a result, translation of the switch 28 fully forward towards the LED 14 exerts a continual transverse pressure urging the leaf spring 54 into simultaneous contact with the opposite pole 42 of the battery 40 and the second lead 52 of the LED 14 thereby activating the LED 14 in a continual fashion. An intermediate position of the switch 28 relative to aperture 24 activates the LED 14 intermittently only through the addition of a transverse pressure on the boss 26 to selectively urge the leaf spring 54 into simultaneous contact with the second LED lead 52 and the opposing battery pole 42. It is appreciated that other types of springs including coil springs, button springs and the like, as well as other switch arrangements, are operative herein to afford both intermittent and continuous activated conditions of a LED.

In a preferred embodiment, the flashlight 10 according to the present invention is resealable after disassembly to component parts. The ability to reseal the flashlight 10 after disassembly allows for the replacement of expended batteries or other components. According to the present invention, an upper panel, frame and lower panel are interconnected through complementary snap fittings molded into the upper and lower panels. With reference to FIG. 2, at least two snap fittings 72 extend from the upper panel 20. The upper panel snap fittings 72 engage complementary snap fittings 74 extending from the lower panel 18. Preferably, at least one alignment pin 76 and alignment hole 77 set are divided between the lower and upper panels to facilitate component alignment before snap fitting the panels together. More preferably, a nub 79 is formed within the interior of the frame 16 in order to facilitate snap fitting of either the upper panel 20 or the lower panel 18 with the frame 16.

Disassembly of the flashlight 10 is facilitated by a notch 78 located in the upper panel 20. The notch 78 is parallel to the frame 16 and a wall of the notch is defined by the frame. The notch 78 is adapted to receive a coin edge, key, paperclip or other small article, the article serving as a lever for separating the upper panel 20 from the remainder of the flashlight 10. Through the use of the notch 78, the flashlight 10 is readily disassembled without resort to specialized tools such as a jeweler's screwdriver.

While the present invention has been described with reference to a self-contained flashlight unit, the invention as detailed herein is readily integrated into more complex structures such as a luggage tag, clipboard, a watchband, lock, key, helmet, knife, toy, toolbox and gun.

The foregoing description is illustrative of particular embodiments of the invention, but is not meant to be a limitation upon the practice thereof. The following claims, including all equivalents thereof, are intended to define the scope of the invention.

What is claimed is:

1. A flashlight comprising:

a battery having opposing surfaces of opposite polarity;

a light emitting diode having a first lead and a second lead extending therefrom, the leads adapted to engage the opposing surfaces of the battery;

a lower panel adapted to receive said battery and said LED;

a frame attached to said lower panel;

an upper panel having an upper surface, a side and an aperture extending through the upper surface; and snap fittings adapted to press fit with said lower panel in simultaneous contact with said frame.

2. The flashlight of claim 1 wherein said upper panel has a notch in the side such that a wall of the notch is defined by said frame and the notch is adapted to receive a lever for detaching said upper panel from said lower panel.

3. The flashlight of claim 1 further comprising a dual function switch adapted to insert between said upper panel and the second lead so that lateral movement of said switch urges the second lead into a condition selected from the group consisting of: constant contact between the leads and the opposing surfaces of said battery, and intermittent contact between the leads and the opposing surfaces of the battery induced by a further transverse pressure exerted on said switch.

4. The flashlight of claim 1 wherein the first lead is in constant contact with a battery pole and said second lead contacts the opposing battery pole through a bridging connector.

5. The flashlight of claim 4 wherein the bridging connector is a leaf spring.

6. The flashlight of claim 1 wherein said frame is metal.

7. The flashlight of claim 6 wherein said frame is pot metal.

8. The flashlight of claim 1 wherein said frame is configured to form a hook.

9. The flashlight of claim 7 further comprising a spring clip urged into contact with the hook.

10. The flashlight of claim 1 wherein the dual function switch has a rocking undercarriage adapted to urge a leaf spring into simultaneous contact with the second lead and the opposing battery pole.

11. The flashlight of claim 1 wherein said battery is a lithium disc battery.

12. The flashlight of claim 1 wherein said LED is a gallium nitride LED.

13. The flashlight of claim 1 wherein at least one of said upper panel and said lower panel is translucent.

14. The flashlight of claim 1 wherein said upper panel and said lower panel are formed of thermoplastic material.

15. The flashlight of claim 1 wherein said frame is metal plated.

16. A flashlight comprising:

a button battery having a battery pole and a second surface of opposite polarity;

a light emitting diode having a first lead and a second lead extending therefrom, the first lead in constant contact with the battery pole;

a lower panel adapted to receive said battery and said LED;

a metal frame attached to said lower panel, wherein a portion of said frame is configured as a hook;

a spring affixed to said frame being urged into contact with the hook;

an upper panel having an upper surface, a side having a notch such that a wall of the notch is defined by said frame, an aperture extending through the upper surface; and snap fittings adapted to press fit with said lower panel in simultaneous contact with said frame.

17. The flashlight of claim 16 further comprising a dual function switch adapted to insert between said upper panel and the second lead so that lateral movement of said switch urges a leaf spring into simultaneous contact between the second lead and the second surface of opposite polarity to induce a condition selected from the group consisting of: constant contact with the second surface of opposite polarity, and intermittent contact between the second lead and the second surface of opposite polarity induced by a further transverse pressure exerted on said switch.

18. The flashlight of claim 16 wherein said frame is pot metal.

19. The flashlight of claim 16 wherein said battery is a lithium disc battery.

20. The flashlight of claim 16 wherein said LED is a gallium nitride LED.

21. The flashlight of claim 16 wherein said upper panel and said lower panel are formed of thermoplastic material.

22. The flashlight of claim 16 wherein said frame is metal plated.

* * * * *

UNITED STATES PATENT AND TRADEMARK OFFICE

CERTIFICATE OF CORRECTION

PATENT NO. : 6,299,323 B1
DATED : October 9, 2001
INVENTOR(S) : Sun Yu et al.

It is certified that error appears in the above-identified patent and that said Letters Patent is hereby corrected as shown below:

Title page,
Item [57], ABSTRACT,
Line 4, (missing line), after "A" but before "adapted" insert -- frame is attached to the lower panel and an upper panel having snap fittings --
Line 9, (missing line), after "a notch", but before "receive" insert -- such that a wall of the notch is defined by the frame and the notch is adapted to --.
Line 15, (missing line), after "self-contained" but before "variety" insert -- unit having an appendage hook or alternatively may be incorporated into a --.

Signed and Sealed this

Thirteenth Day of August, 2002

*Attest:*

*Attesting Officer*

JAMES E. ROGAN
*Director of the United States Patent and Trademark Office*